US010240601B2

(12) United States Patent
Nakano et al.

(10) Patent No.: US 10,240,601 B2
(45) Date of Patent: Mar. 26, 2019

(54) SCROLL COMPRESSOR

(71) Applicant: Johnson Controls—Hitachi Air Conditioning Technology (Hong Kong) Limited, Hong Kong (CN)

(72) Inventors: Yasunori Nakano, Tokyo (JP); Shuji Hasegawa, Tokyo (JP); Satoshi Nakamura, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 242 days.

(21) Appl. No.: 15/113,265

(22) PCT Filed: Oct. 27, 2014

(86) PCT No.: PCT/JP2014/078434
§ 371 (c)(1),
(2) Date: Jul. 21, 2016

(87) PCT Pub. No.: WO2015/111267
PCT Pub. Date: Jul. 30, 2015

(65) Prior Publication Data

US 2016/0348677 A1 Dec. 1, 2016

(30) Foreign Application Priority Data

Jan. 22, 2014 (JP) ..... 2014-009083

(51) Int. Cl.
*F04C 23/00* (2006.01)
*F04B 39/12* (2006.01)
(Continued)

(52) U.S. Cl.
CPC ..... *F04C 18/0253* (2013.01); *F01C 21/10* (2013.01); *F04C 18/0215* (2013.01);
(Continued)

(58) Field of Classification Search
CPC ..... F04C 23/008; F04C 2230/60; F04C 2240/30; F04C 2/04; F04C 2/103; B23K 2101/12; F01C 1/30
(Continued)

(56) References Cited

U.S. PATENT DOCUMENTS 6,193,485 B1 * 2/2001 Ueda ..... F04B 39/121 417/902
2006/0127260 A1 6/2006 Um
(Continued)

FOREIGN PATENT DOCUMENTS

EP 1703129 A2 * 9/2006 ..... F01C 21/0809
JP 08-177757 A 7/1996
(Continued)

OTHER PUBLICATIONS

English Translation of JP 2013169565 by Espacenet Nov. 3, 2018.*
International Search Report of PCT/2014/078434 dated Feb. 3, 2015.

*Primary Examiner* — Mary A Davis
*Assistant Examiner* — Deming Wan
(74) *Attorney, Agent, or Firm* — Mattingly & Malur, PC

(57) ABSTRACT

A scroll compressor has a sealed container inside which a working fluid is sealed; a frame fixed inside the sealed container; a fixed scroll provided with a fixed-side spiral body formed in a spiral shape on a fixed-side base plate fixed inside the sealed container; and a revolving scroll in which a revolving-side spiral body meshing with the fixed-side spiral body is provided on a revolving-side base plate. The frame includes a first welded point at which the frame is fixed by welding to the sealed container, and a revolving-scroll-receiving surface supports a bottom surface of the revolving-side base plate opposite to a surface thereof on which the revolving-side spiral body is provided. A frame outer peripheral groove provided in an outer periphery of the
(Continued)

frame faces an inner periphery of the sealed container between the revolving-scroll-receiving surface and the first welded point.

7 Claims, 7 Drawing Sheets

(51) Int. Cl.

| | |
|---|---|
| ***B23K 33/00*** | (2006.01) |
| ***B23K 101/12*** | (2006.01) |
| ***F04C 18/02*** | (2006.01) |
| ***F01C 1/02*** | (2006.01) |
| ***F01C 21/10*** | (2006.01) |
| ***F04C 29/00*** | (2006.01) |

(52) U.S. Cl.
CPC ..... *F04C 23/008* (2013.01); *F04C 29/0057* (2013.01); *F04C 2210/268* (2013.01); *F04C 2230/231* (2013.01); *F04C 2240/20* (2013.01)

(58) Field of Classification Search
USPC ..... 418/55.1–55.5, 57; 417/310, 902; 29/888.022
See application file for complete search history.

(56) References Cited

U.S. PATENT DOCUMENTS

| | | | | |
|---|---|---|---|---|
| 2007/0031275 | A1* | 2/2007 | Nogawa | F04C 29/0021 418/55.2 |
| 2016/0003247 | A1* | 1/2016 | Matsumura | F04C 18/0215 417/410.5 |

FOREIGN PATENT DOCUMENTS

| | | | | | |
|---|---|---|---|---|---|
| JP | 2008-190467 | A | | 8/2008 | |
| JP | 2009-057947 | A | | 3/2009 | |
| JP | 2009-174395 | A | | 8/2009 | |
| JP | 2013169565 | A | * | 9/2013 | B23K 26/28 |

* cited by examiner

SCROLL COMPRESSOR

TECHNICAL FIELD

The present invention relates to scroll compressors.

BACKGROUND ART

There is as a background art of the present invention one described in Japanese Unexamined Patent Publication Gazette No. H08-177757 (Patent Literature 1). This gazette describes "A hermetic scroll compressor having a structure in which a scroll compression mechanism unit constituted by a compression mechanism section composed of a fixed scroll, a revolving scroll, a frame, an anti-rotation mechanism, and other members and a drive section composed of a crankshaft connected to the revolving scroll, an electric motor operable to drive the crankshaft, and other members is contained in a sealed container, a plurality of feet or a ring-shaped body portion is provided at each of locations on an outer periphery of the frame, two locations on a compression mechanism section side in an axial direction with respect to a centroid position of the scroll compression mechanism unit and one location on a drive section side in the axial direction with respect to the centroid position, and the outer periphery of the body of the frame is inserted in the sealed container along an inner periphery of the sealed container, wherein the outer peripheries of the feet or ring-shaped body portions of the frame provided on both sides in the axial direction with respect to the centroid position of the scroll compression mechanism unit are fully fastened by press fit, welding or other means to the inner periphery of the sealed container and the frame outer periphery of the compression mechanism section located at a fastening surface between the frame and the fixed scroll is provided with a clearance from or transition fitted in the inner periphery of the sealed container.

CITATION LIST

Patent Literature 1: JP-A-H08-177757

SUMMARY OF INVENTION

Technical Problem

A scroll compressor compresses a working fluid in a compression chamber formed so as to be enclosed by respective base plates and scroll bodies of a revolving scroll and a fixed scroll. When, without an axial clearance between the revolving scroll and the fixed scroll, the revolving scroll is excessively pressed against the fixed scroll, the sliding resistance of the revolving scroll increases, which may not only increase the input to the compressor to cause a performance deterioration but also interfere with the revolving motion of the revolving scroll to cause an operation failure. Therefore, by providing a mechanism that secures such an axial clearance in assembling the revolving scroll and the fixed scroll and presses the revolving scroll against the fixed scroll during operation, the axial clearance can be filled in to prevent leakage of the working fluid in the compression chamber.

On the other hand, if the axial clearance between the revolving scroll and the fixed scroll is too large in assembling them, the pressing force of the revolving scroll against the fixed scroll may become insufficient to increase the leakage of the working fluid in the compression chamber and thus deteriorate the compressor performance. Therefore, the dimensions for the axial clearance between the scrolls are strictly managed to minimize the axial clearance so long as the revolving scroll is not excessively pressed against the fixed scroll.

The frame is a component that holds the revolving scroll on its revolving-scroll-receiving surface and holds the fixed scroll on its fixed-scroll-fastening surface and, therefore, the depth of the frame from the fixed-scroll-fastening surface to the revolving-scroll-receiving surface is a critical dimension for the axial clearance between the scrolls.

However, in fixing the frame to the sealed container by press fit or welding, deformation due to loads or heat occurs in the frame. The deformation may vary the depth of the frame from the fixed-scroll-fastening surface to the revolving-scroll-receiving surface to make the axial clearance between the scrolls inappropriate, which may cause the above-described performance deterioration or operation failure.

In Patent Literature 1, ring-shaped projections are provided on the outer periphery of the frame, the fixation to the sealed container is made by press fit or welding at the projections, and a clearance is provided between a portion of the frame outer periphery located on the compression mechanism section side and having the fixed-scroll-fastening surface and the inner wall of the sealed container, thus suppressing deformation of the fixed-scroll-fastening surface of the frame due to press fit in the sealed container.

However, in Patent Literature 1, although it is possible to suppress deformation of the frame outer periphery due to press fit, the fixation of the frame by welding may cause the inner periphery of the frame, particularly the fixed-scroll-fastening surface and the revolving-scroll-receiving surface, to deform, resulting in a performance deterioration or an operation failure of the compressor.

In view of the foregoing, an object of the present invention is to improve reliability in a scroll compressor in which a frame is fixed by welding.

Solution to Problem

To solve the above problems, the present invention features a scroll compressor provided with: a sealed container inside which a working fluid is sealed; a frame fixed inside the sealed container; a fixed scroll provided with a fixed-side spiral body formed in a spiral shape on a fixed-side base plate fixed inside the sealed container; and a revolving scroll in which a revolving-side spiral body meshing with the fixed-side spiral body is provided on a revolving-side base plate, the revolving scroll moving in a revolving manner, wherein the frame includes a first welded point at which the frame is fixed by welding to the sealed container, a revolving-scroll-receiving surface supporting a bottom surface of the revolving-side base plate opposite to a surface thereof on which the revolving-side spiral body is provided, and a frame outer peripheral groove provided in an outer periphery of the frame facing an inner periphery of the sealed container and between the revolving-scroll-receiving surface and the first welded point.

Advantageous Effects of Invention

In accordance with the present invention, reliability can be improved in the scroll compressor in which a frame is fixed by welding.

DESCRIPTION OF EMBODIMENTS

Embodiment 1

Figure 1:
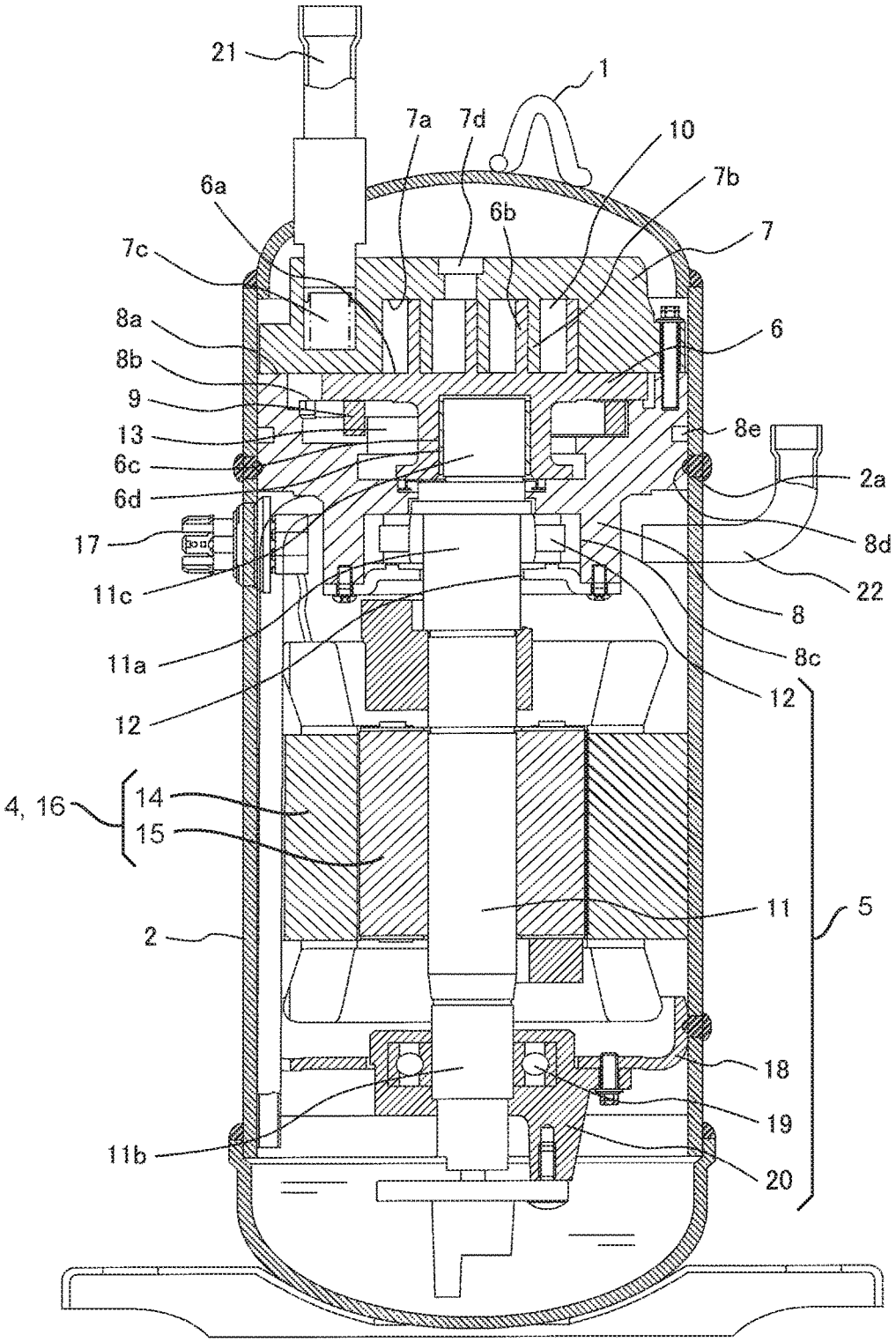
FIG. 1 shows a longitudinal cross-sectional view of a scroll compressor in Embodiment 1 of the present invention.

FIG. 1 shows a scroll compressor according to a first embodiment for working of the present invention. A scroll compressor 1 is constructed by containing a compression mechanism section 3, a drive section 4, and a rotary shaft section 5 in a sealed container 2.

The compression mechanism section 3 is composed of, as essential elements, a revolving scroll 6, a fixed scroll 7, a frame 8, and an anti-rotation mechanism 9. The revolving scroll 6 is composed of, as essential elements, a revolving-side base plate 6*a*, a revolving-side spiral body 6*b*, a revolving scroll bearing section 6*c*, and a slide bearing 6*d* provided in the revolving scroll bearing section 6*c*. The revolving-side spiral body 6*b* is provided standing vertically from one side of the revolving-side base plate 6*a*. The revolving scroll bearing section 6*c* is formed projecting vertically on the opposite side of the revolving-side base plate 6*a* to the spiral body.

The fixed scroll 7 is composed of, as essential elements, a fixed-side base plate 7*a*, a fixed-side spiral body 7*b* provided standing vertically from the fixed-side base plate 7*a*, a suction port 7*c*, and a discharge port 7*d* and fixed by bolts to the frame 8 to allow the fixed-side spiral body 7*b* to be opposed to the revolving-side spiral body 6*b* to define a compression chamber 10.

The anti-rotation mechanism 9 is contained in the frame 8 and engages with the opposite side of the revolving-side base plate 6*a* to the spiral body so that the revolving scroll 6 cannot rotate but can move in a revolving manner with respect to the fixed scroll 7.

The frame 8 is composed of, as essential elements, a fixed-scroll-fastening surface 8*a* to which the fixed scroll 7 is fastened by bolts, a revolving-scroll-receiving surface 8*b* holding the revolving-side base plate 6*a*, and a frame bearing section 8*c* that houses a main bearing 12 holding a crankshaft 11 rotatably. Furthermore, the frame 8 is fixed by press fit or welding to the inner wall of the sealed container 2 so that a rotor 15 fixed to the crankshaft 11 can rotate while keeping a certain distance from a stator 14 constituting, together therewith, an electric motor 16. The description as follows will be given of the case where the frame 8 is fixed by plug welding to the sealed container 2 and details thereof will be described later.

The compression mechanism section 3 is provided with a back pressure chamber 13 defined by the frame 8, the opposite side of the revolving-side base plate 6*a* to the spiral body, and the fixed scroll 7. The back pressure chamber 13 is provided with a passage (not shown) communicated with a discharge pressure space and a passage (not shown) communicated with a throttle mechanism (not shown) and the compression chamber 10 being in the middle of compression, thus keeping the interior of the back pressure chamber at an intermediate pressure between a suction pressure and a discharge pressure (hereinafter referred to simply as an intermediate pressure).

The revolving scroll 6 is pressed against the fixed scroll 7 by the intermediate pressure from the back pressure chamber 13 to maintain the axial sealability of the revolving scroll 6 and fixed scroll 7 in the compression chamber 10.

The drive section 4 constitutes, as an essential element, an electric motor 16 composed of a stator 14 and a rotor 15. Herein, the electric motor 16 is driven by an electric input from a power supply (not shown) via an electric terminal 17 to impart a rotating action to the crankshaft 11.

The rotary shaft section 5 is composed of, as essential elements, the crankshaft 11, the main bearing 12, a sub frame 18, a sub bearing 19, and a sub bearing housing 20. The crankshaft 11 is composed of, as essential elements, a main shaft 11*a*, a sub shaft 11*b*, and an eccentric pin 11*c*, held rotatably at the main shaft 11*a* by the main bearing 12, and held rotatably at the sub shaft 11*b* by the sub bearing 19. The crankshaft 11 is connected to the stator 14 between the main shaft 11*a* and the sub shaft 11*b*. The eccentric pin 11*c* is engaged through the slide bearing 6*d* with the revolving scroll 6. The main bearing 12 is provided in the frame bearing section 8*c*. The sub frame 18 is provided on the side of the crankshaft 11 opposite to the compression mechanism section with respect to the electric motor 16 in the axial direction and holds the sub bearing housing 20. The sub frame 18 is fixed by plug welding to the sealed container 2. The sub bearing housing 20 is provided in the sub frame 18 and holds the sub bearing 19.

By the rotating action of the crankshaft 11 driven by the electric motor 16 via the stator 14, the revolving scroll 6 moves in a revolving manner to reduce the capacity of the compression chamber 10 mechanically constructed by meshing of the revolving-side spiral body 6*b* and the fixed-side spiral body 7*b*, thus performing a compressing operation.

The working fluid is sucked from the outside of the sealed container 2 into the compression chamber 10 via a suction pipe 21 provided at the sealed container 2 and connected to the fixed scroll suction port 7*c*, subjected to a compression stroke, discharged through the discharge port 7*d* into the sealed container 2, and then discharged to the outside of the sealed container 2 through a discharge pipe 22 provided at the sealed container 2.

Figure 2:
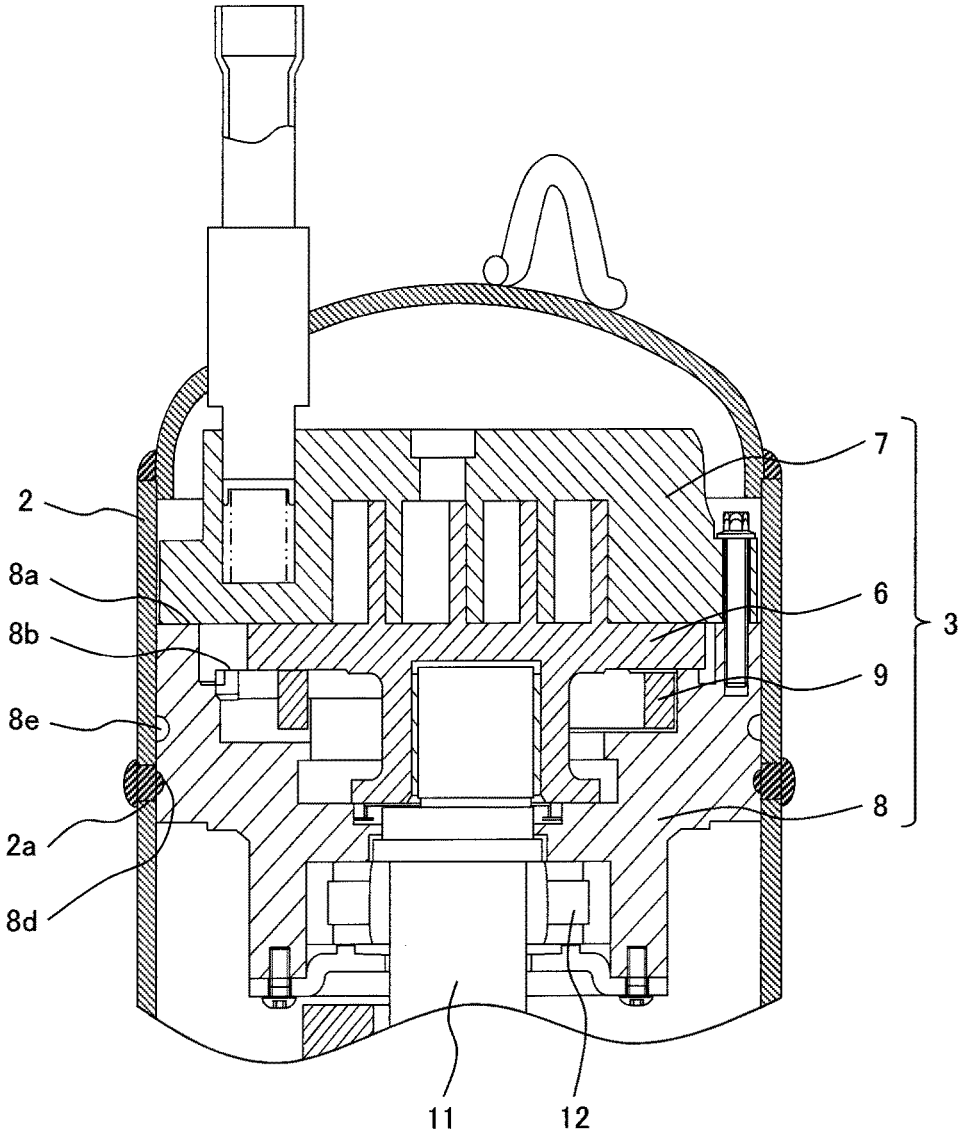
FIG. 2 is a longitudinal cross-sectional view of welded frame portions and their surroundings in Embodiment 1 of the present invention.

FIG. 2 shows a detailed view of welded points between the frame 8 and the sealed container 2 and their surroundings in this embodiment. The sealed container 2 has plug welding holes 2*a* and the frame 8 is fixed thereto by plug welding at the plug welding holes 2*a*. The plug welding holes 2*a* are provided at a plurality of points on an approximately cylindrically shaped body portion of the sealed container 2, at the same position in the axial direction of the crankshaft 11, and along the circumferential direction of the body portion.

The frame 8 is provided with plug welded points 8*d* which are points at which it is plug welded to the sealed container 2. These plug welded points 8*d* are provided on the side opposite to the scrolls with respect to the revolving-scroll-receiving surface 8*b* in the axial direction of the crankshaft 11. In other words, supposing that the position where the fixed scroll 7 is disposed is located upwardly of the other components, the plug welded points 8*d* are provided downwardly away from the revolving-scroll-receiving surface 8*b* and in a lower portion of the outer periphery of the frame 8 facing the inner periphery of the sealed container 2.

The outer periphery of the frame 8 having the plug welded points 8*d* is provided with a frame outer peripheral groove 8*e* at a position between the revolving-scroll-receiving surface 8*b* and the plug welded points 8*d* in the axial direction of the crankshaft 11 and along the circumferential direction of the frame 8 outer periphery facing the sealed container 2 inner periphery.

By providing this frame outer peripheral groove 8*e*, deformation of the frame 8 due to plug welding is produced at the frame outer peripheral groove 8*e*, which prevents the effect of the deformation from being transmitted above the frame outer peripheral groove 8*e*. Thus, the deformation of the frame 8 due to plug welding can be localized at and downwardly of the frame outer peripheral groove 8*e*, i.e., closer to the plug welded point 8*d* than the frame outer peripheral groove 8*e*, so that the deformation of the fixed-scroll-fastening surface 8*a* and the revolving-scroll-receiving surface 8*b* of the frame 8 can be suppressed.

Figure 3:
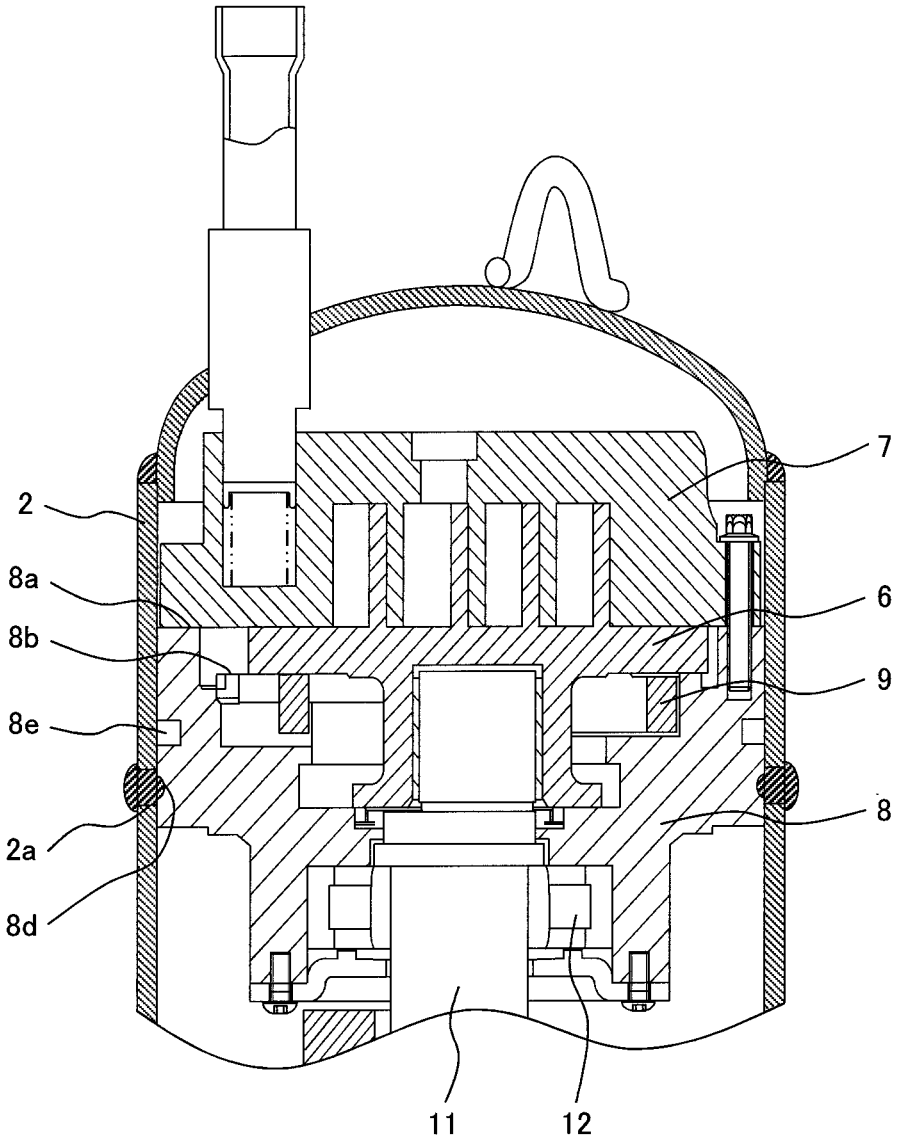
FIG. 3 is a longitudinal cross-sectional view of welded frame portions and their surroundings when the sectional shape of a frame outer periphery groove is rectangular in Embodiment 1 of the present invention.

It is preferred that, to further promote the localization of deformation of the frame 8 due to plug welding, the cross-sectional shape of the frame outer peripheral groove 8*e* when cut in a direction from the plug welded points 8*d* toward the revolving-scroll-receiving surface 8*b* (the cross-sectional shape thereof in a radial direction of the compressor) be, as shown in FIG. 3, an approximately rectangular shape in which case the cross-sectional area of the frame outer peripheral groove 8*e* becomes larger. Furthermore, to promote the localization of deformation of the frame 8 due to plug welding and allow the frame outer peripheral groove 8*e* to be processed in the same process as the outer periphery of the frame 8 to thus improve workability of the process, it is preferred that the frame outer peripheral groove 8*e* should be formed as an annular groove to extend all around the outer periphery of the frame 8.

In the above manner, the axial clearance between the revolving scroll 6 and the fixed scroll 7 can be reduced, without excessively pressing the revolving scroll 6 against the fixed scroll 7, to reduce the possibility of performance deterioration of the compressor due to leakage in the process of compression, the possibility of input increase due to excessive sliding friction of the revolving scroll, and the possibility of operation failure of the compressor, thus improving the performance and reliability of the compressor.

Furthermore, when in a conventional compressor a refrigerant of small density, such as R32, is used as a working fluid, leakage thereof that may occur in the process of compression is greater than in a conventional compressor using R410A or the like. Therefore, particularly in the case where a refrigerant of small density, such as R32, is used, the performance can be significantly improved.

Although in this and subsequent embodiments a description is given of the case where plug welding is employed as the welding process for fixing the sealed container 2 and the frame 8 together, the above effects resulting from the provision of the frame outer peripheral groove 8*e* can be achieved likewise in the case where they are fixed together by the other welding processes.

Embodiment 2

Figure 4:
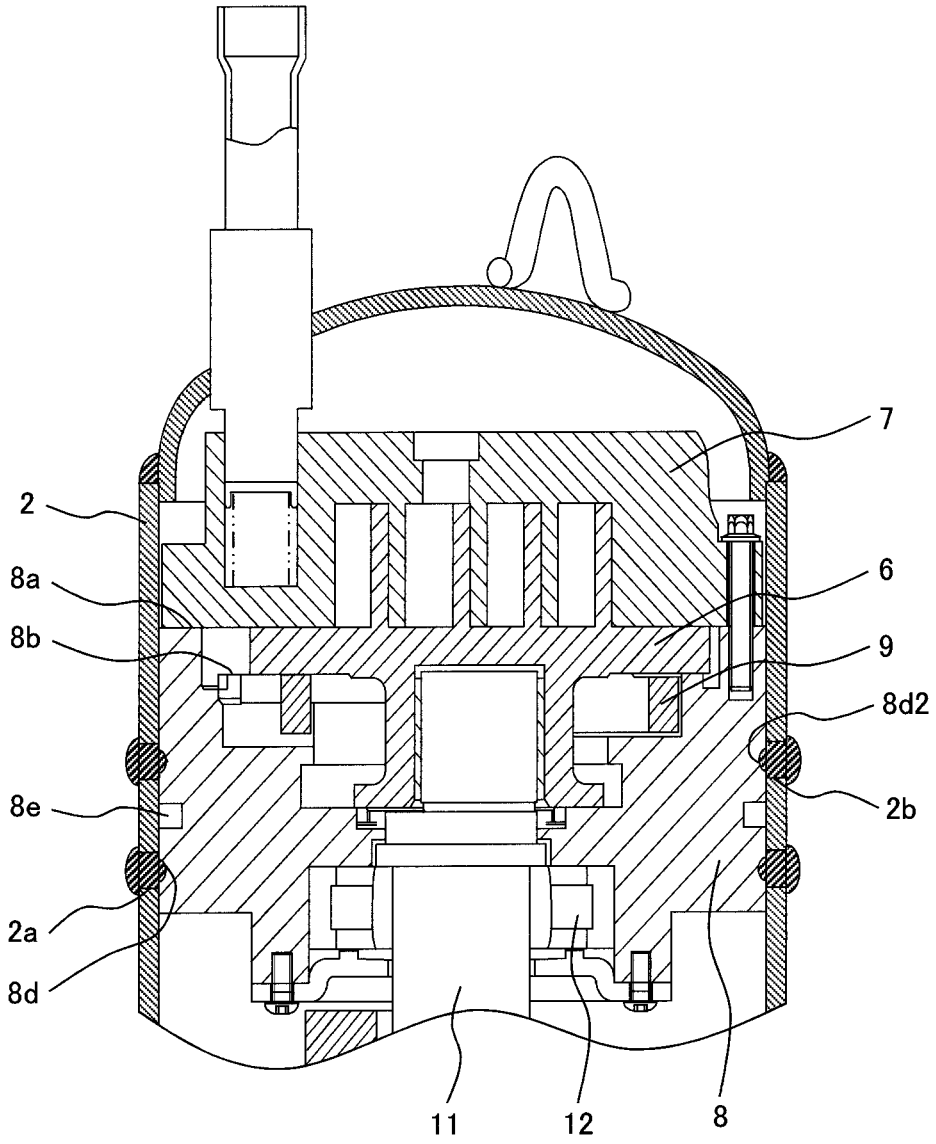
FIG. 4 is a longitudinal cross-sectional view of welded frame portions and their surroundings in Embodiment 2 of the present invention.

FIG. 4 shows a detailed view of welded points between the frame 8 and the sealed container 2 and their surroundings in this embodiment. The other portions are the same as in Embodiment 1 and are therefore omitted. The sealed container 2 has first plug welding holes 2*a* and second plug welding holes 2*b* located closer to the scrolls in the axial direction of the crankshaft 11 than the first plug welding holes 2*a* and the frame 8 is fixed thereto by plug welding at the first plug welding holes 2*a* and the second plug welding holes 2*b*.

The first plug welding holes 2*a* are provided at a plurality of points on the sealed container 2, at the same position in the axial direction of the crankshaft 11, and along the circumferential direction of the sealed container 2. The second plug welding holes 2*b* are likewise provided at a plurality of points on the sealed container 2, at the same position in the axial direction of the crankshaft 11, and along the circumferential direction of the sealed container 2.

First welded points 8*d* of the frame 8 at which the frame 8 is plug welded through the first plug welding holes 2*a* to the sealed container 2 and second welded points 8*d*2 of the frame 8 at which the frame 8 is plug welded through the second plug welding holes 2*b* to the sealed container 2 are provided on the side opposite to the scrolls with respect to the revolving-scroll-receiving surface 8*b* in the axial direction of the crankshaft 11, i.e., downwardly of the revolving-scroll-receiving surface 8*b*. The outer periphery of the frame 8 having the first plug welded points 8*d* and second plug welded point 8*d*2 is provided with a frame outer peripheral groove 8*e* at a position between the first plug welded points 8*d* and the second plug welded points 8*d*2 in the axial direction of the crankshaft 11 and along the circumferential direction of the outer periphery of the frame 8. The second plug welded point 8*d*2 are located between the frame outer peripheral groove 8*e* and the revolving-scroll-receiving surface 8*b*.

By providing the second welded points 8*d*2, shear stress occurring at the frame welded points owing to, for example, compression of the working fluid by the compression chamber 10 can be reduced to improve the reliability of the compressor. Furthermore, in this embodiment, the frame 8 can be more firmly fixed to the sealed container 2 than in the first embodiment, which is a means effective for achieving higher-speed rotation of the compressor and a higher pressure ratio in the sealed container 2.

In addition, by providing the frame outer peripheral groove 8*e*, the deformation of the frame 8 due to plug welding at the first welded points 8*d* can be localized closer to the first welded point 8*d* than the groove 8*e*, so that it can be suppressed that the deformation of the fixed-scroll-fastening surface 8*a* and the revolving-scroll-receiving surface 8*b* of the frame 8 increases owing to increased welded points.

It is preferred that the second welded points 8*d*2 should be arranged at a position closer to the frame outer peripheral groove 8*e* than the revolving-scroll-receiving surface 8*b*. By this arrangement, it becomes likely that the deformation of the frame 8 that may occur when the frame 8 is plug welded at the second plug welded points 8*d*2 is localized closer to the frame outer peripheral groove 8*e*.

In the above manner, the axial clearance between the revolving scroll 6 and the fixed scroll 7 can be reduced, without excessively pressing the revolving scroll 6 against the fixed scroll 7, to reduce the possibility of performance deterioration of the compressor due to leakage in the process of compression, the possibility of input increase due to excessive sliding friction of the revolving scroll, and the possibility of operation failure of the compressor, thus improving the performance and reliability of the compressor.

Embodiment 3

Figure 5:
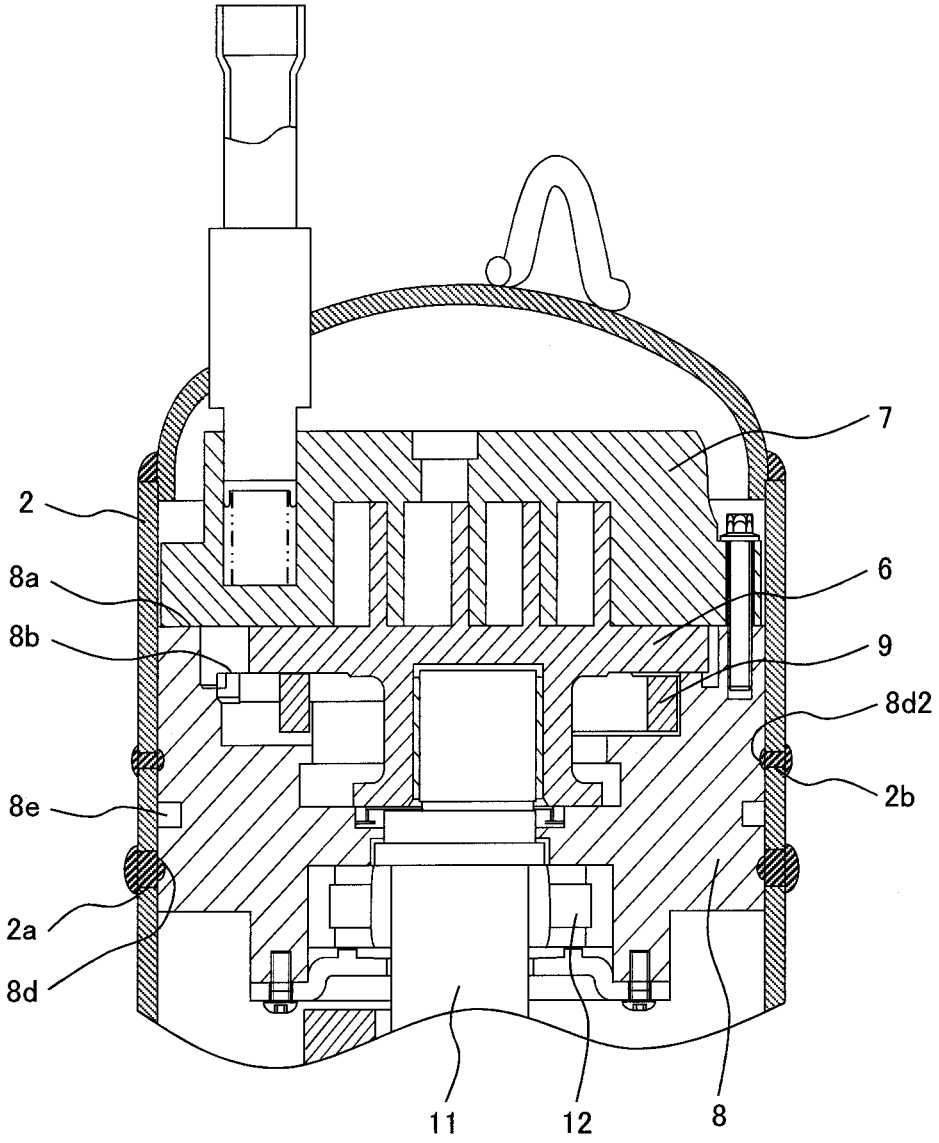
FIG. 5 is a longitudinal cross-sectional view of welded frame portions and their surroundings in Embodiment 3 of the present invention.

FIG. 5 shows a detailed view of welded points between the frame 8 and the sealed container 2 and their surroundings in this embodiment. The other portions are omitted because they are the same as in Embodiment 1, and the description of the frame 8 and the sealed container 2 common with Embodiment 2 will be omitted. The same applies to the subsequent embodiments.

In this embodiment, the second plug welding holes 2*b* are provided closer to the scrolls than the first plug welding holes 2*a*, like Embodiment 2. Furthermore, the hole diameter of the second plug welding holes 2*b* is designed to be smaller than that of the first plug welding holes 2*a*.

This will now be further described. Since the plug welding is to weld the sealed container 2 and the frame 8 by filling the plug welding holes 2*a* and 2*b* provided in the sealed container 2 with welding, the heat applied to the frame 8 during welding increases in proportion to the hole diameter of the plug welding hole. Furthermore, the second plug welding holes provided at a position closer to the revolving-scroll-receiving surface 8*b* than the first plug welding holes have a greater deforming effect on the revolving-scroll-receiving surface 8*b* during plug welding than the first plug welding holes. Therefore, in the case of increasing the welded points, by making the diameter of the second plug welding holes 2*b* arranged at a position closer to the revolving-scroll-receiving surface 8*b* smaller than that of the first plug welding holes 2*a*, the increase in the deformation of the fixed-scroll-fastening surface 8*a* and the revolving-scroll-receiving surface 8*b* of the frame 8 can be suppressed. Thus, the deformation of the revolving-scroll-receiving surface 8*b* due to welding can be reduced while the force of fixation of the frame 8 to the sealed container 2 can be increased by providing a plurality of welded points in the axial direction of the crankshaft 11 on the frame 8.

Embodiment 4

Figure 6:
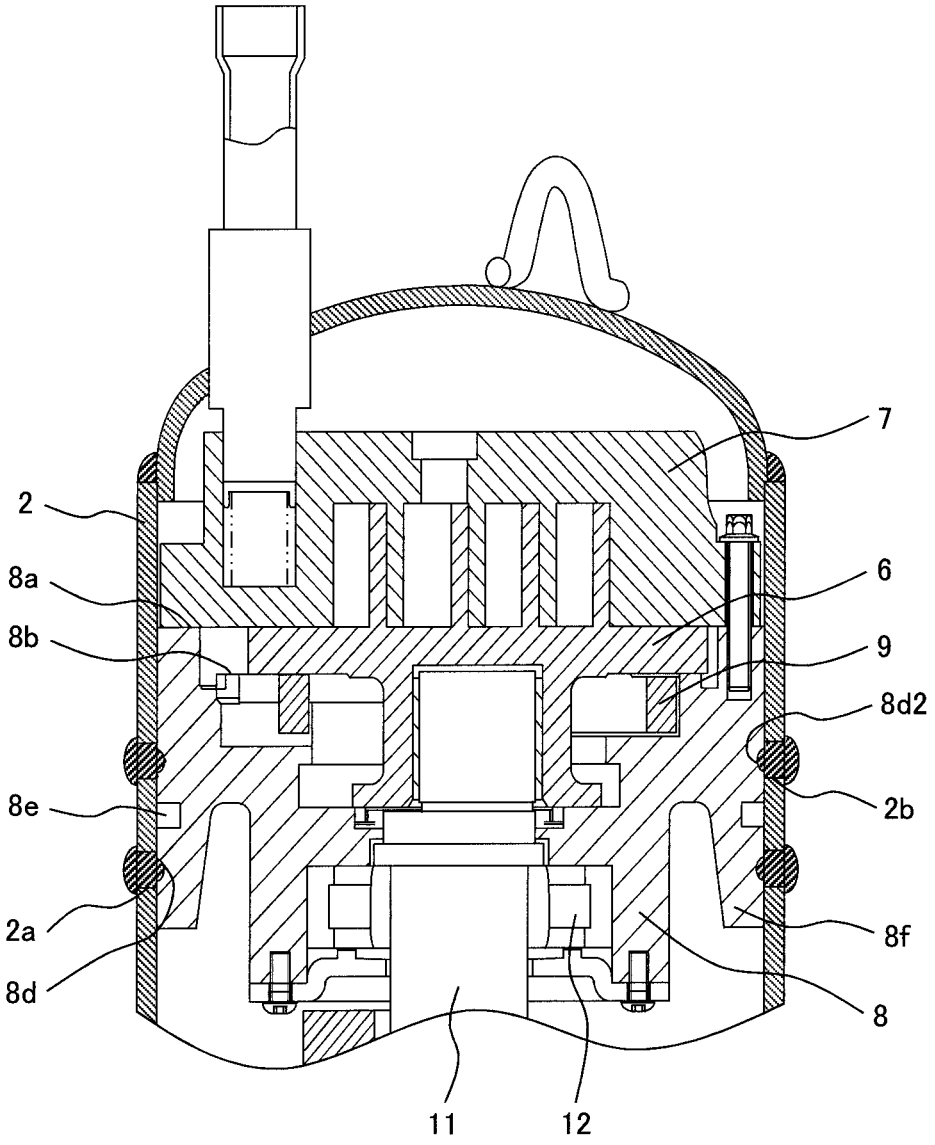
FIG. 6 is a representative longitudinal cross-sectional view of welded frame portions and their surroundings in Embodiment 4 of the present invention.

FIG. 6 shows a detailed view of welded points between the frame 8 and the sealed container 2 and their surroundings in this embodiment. The other portions are the same as in Embodiment 1 and are therefore omitted. The frame 8 in this embodiment has, at its outer periphery, a leg 8*f* projecting like a cantilever on the side opposite to the scrolls in the axial direction of the crankshaft 11. This leg 8*f* is formed in a shape projecting from the outer periphery of the frame 8 in a direction away from the revolving-scroll-receiving surface 8*b* and along the inner periphery of the sealed container 2. The plug welded points 8*d* to the sealed container 2 are provided on the leg 8*f*. The side surface of the leg 8*f* having the plug welded points 8*d* is provided with a frame outer peripheral groove 8*e* at a position between the revolving-scroll-receiving surface 8*b* and the plug welded points 8*d* in the axial direction of the crankshaft 11 and along the circumferential direction.

Because in this manner the plug welded points 8*d* can be arranged at a position away from the revolving-scroll-receiving surface 8*b*, the deformation of the revolving-scroll-receiving surface 8*b* can be further suppressed. Furthermore, by also providing the frame outer peripheral groove 8*e* in the leg 8*f*, the deformation of the frame 8 due to plug welding can be localized closer to the plug welded point 8*d* than the frame outer peripheral groove 8*e* and the position of localization can be kept away from the revolving-scroll-receiving surface 8*b*, so that the deformation of the revolving-scroll-receiving surface 8*b* can be further suppressed. In addition, by giving the outer periphery of the frame 8 a projected shape, the plug welded points 8*d* can be kept away from the revolving-scroll-receiving surface 8*b* while the increase in weight of the frame 8 can be suppressed.

In this embodiment, the second plug welded points 8*d*2 between the frame 8 and the sealed container 2 may be provided, like Embodiment 2, between the frame outer peripheral groove 8*e* and the revolving-scroll-receiving surface 8*b* in the axial direction of the crankshaft 11. Furthermore, the hole diameter of the second plug welding holes 2*b* may be designed to be smaller than that of the first plug welding holes 2*a*, like Embodiment 3. FIG. 6 shows as a representative view an embodiment where the second plug welded points 8*d*2 between the frame 8 and the sealed container 2 are provided, like Embodiment 2, between the frame outer peripheral groove 8*e* and the revolving-scroll-receiving surface 8*b* in the axial direction of the crankshaft 11.

Embodiment 5

Figure 7:
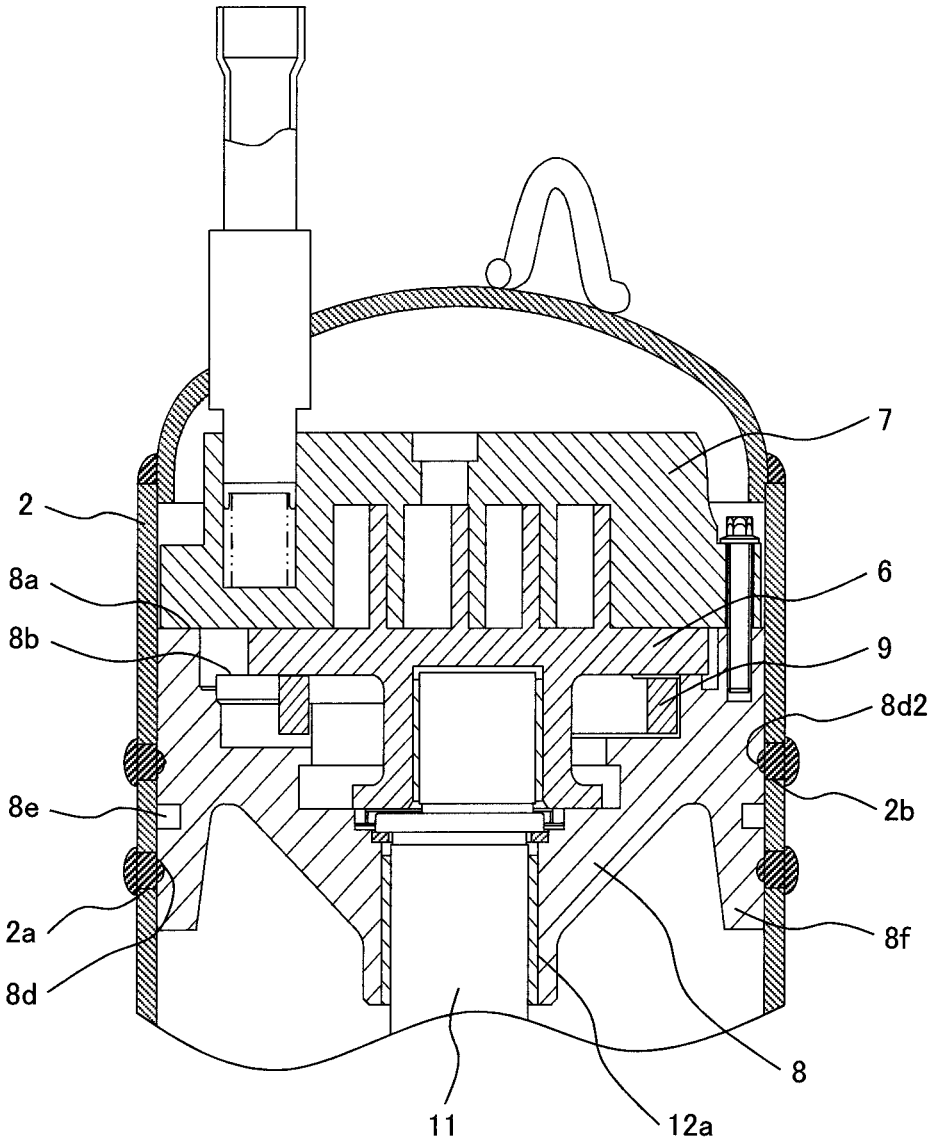
FIG. 7 is a representative longitudinal cross-sectional view of welded frame portions and their surroundings in Embodiment 5 of the present invention.

FIG. 7 shows a detailed view of welded points between the frame 8 and the sealed container 2 and their surroundings in this embodiment. The other portions are the same as in Embodiment 1 and are therefore omitted. The plug welded points 8*d* at which the frame 8 is plug welded to the sealed container 2 are provided on the side opposite to the scrolls with respect to the revolving-scroll-receiving surface 8*b* in the axial direction of the crankshaft 11. The side surface of the frame 8 having the plug welded points 8*d* is provided with a frame outer peripheral groove 8*e* at a position between the revolving-scroll-receiving surface 8*b* and the plug welded points 8*d* in the axial direction of the crankshaft 11 and along the circumferential direction. The frame bearing section 8*c* of the frame 8 is provided with a slide bearing 12*a* as a main bearing. A slide bearing is generally small in size as compared to a ball bearing. Therefore, by using a slide bearing as the main bearing 12, the frame bearing section 8*c* can be reduced in size, thus the frame 8 can be reduced in size and weight. However, by reducing the frame 8 in size, the degree of deformation of the frame 8 due to plug welding may be increased relative to the size of the frame 8.

Therefore, in the case where a slide bearing is used in the frame bearing section 8*c*, providing the frame outer peripheral groove 8*e* is more effective, that is, the deformation of the frame 8 due to plug welding can be suppressed while the frame 8 can be reduced in size and weight.

In this embodiment, the second plug welded points 8*d*2 between the frame 8 and the sealed container 2 may be provided, like Embodiment 2, between the groove 8*e* and the revolving-scroll-receiving surface 8*b* in the axial direction of the crankshaft 11. Furthermore, the hole diameter of the second plug welding holes 2*b* may be designed to be smaller than that of the first plug welding holes 2*a*, like Embodiment 3. Moreover, like Embodiment 4, the outer periphery of the frame 8 may be provided with a leg 8*f* projecting like a cantilever on the side opposite to the scrolls in the axial direction of the crankshaft 11 and the plug welded points 8*d* to the sealed container 2 may be provided on the leg 8*f*. In this case, the groove 8*e* is provided in the side surface of the leg 8*f* having the plug welded points 8*d*, at a position between the revolving-scroll-receiving surface 8*b* and the plug welded points 8*d* in the axial direction of the crankshaft 11, and along the circumferential direction. FIG. 7 shows as a representative view an embodiment where second welded points 8*d*2 to the sealed container 2 are provided on the frame 8 like Embodiment 2 and the frame 8 is provided with a leg 8*f* like Embodiment 4.

REFERENCE SIGNS LIST

1 scroll compressor
2 sealed container
2*a* plug welding hole (first plug welding hole)
2*b* second plug welding hole
3 compression mechanism section
4 drive section
5 rotary shaft section
6 revolving scroll
6*a* revolving-side base plate
6*b* revolving-side spiral body
6*c* revolving scroll bearing section
6*d* slide bearing of the revolving scroll
7 fixed scroll
7*a* fixed-side base plate
7*b* fixed-side spiral body
7*c* suction port in the fixed scroll
7*d* discharge port in the fixed scroll
8 frame
8*a* fixed-scroll-fastening surface
8*b* revolving-scroll-receiving surface
8*c* frame bearing section
8*d* plug welded point (first plug welded point)
8*d*2 second plug welded point
8*e* frame outer peripheral groove
8*f* frame leg
9 anti-rotation mechanism
10 compression chamber
11 crankshaft
11*a* main shaft of the crankshaft
11*b* sub shaft of the crankshaft
11*c* eccentric pin of the crankshaft
12 main bearing
12*a* slide bearing
13 back pressure chamber
14 stator
15 rotor
16 electric motor
17 electric terminal
18 sub frame
19 sub bearing
20 sub bearing housing
21 suction pipe
22 discharge pipe

The invention claimed is:

1. A scroll compressor, comprising:

a sealed container inside which a working fluid is sealed;

a frame fixed inside the sealed container;

a fixed scroll provided with a fixed-side spiral body formed in a spiral shape on a fixed-side base plate fixed inside the sealed container; and a revolving scroll in which a revolving-side spiral body meshing with the fixed-side spiral body is provided on a revolving-side base plate, the revolving scroll moving in a revolving manner, wherein the frame includes a first welded point at which the frame is fixed by welding to the sealed container, a revolving-scroll-receiving surface supporting a bottom surface of the revolving-side base plate opposite to a surface thereof on which the revolving-side spiral body is provided, and a frame outer peripheral groove provided in an outer periphery of the frame facing an inner periphery of the sealed container and between the revolving-scroll-receiving surface and the first welded point, and wherein a second welded point is provided between the frame outer peripheral groove and the revolving-scroll-receiving surface.

2. The scroll compressor according to claim 1, wherein the sealed container is fixed by plug welding to the frame and includes a first plug welding hole provided corresponding to the first welded point and a second plug welding hole corresponding to the second welded point, and wherein the second plug welding hole has a smaller diameter than the first plug welding hole.

3. The scroll compressor according to claim 1, wherein the frame outer peripheral groove has a rectangular cross-sectional shape when the frame is cut from the first welded point toward the revolving-scroll-receiving surface.

4. The scroll compressor according to claim 1, wherein the frame outer peripheral groove is an annular groove extending all around the outer periphery of the frame.

5. The scroll compressor according to claim 1, wherein the frame includes a frame leg projecting from the outer periphery of the frame in a direction away from the revolving-scroll-receiving surface and along the inner periphery of the sealed container, and wherein the first welded point is provided on the frame leg.

6. The scroll compressor according to claim 1, including: a crankshaft provided on a bottom side of the revolving-side base plate to allow the revolving scroll to move in the revolving manner; and a frame bearing section provided at the frame to support the crankshaft in a slide bearing.

7. The scroll compressor according to claim 1, wherein R32 refrigerant is used as the working fluid.

* * * * *